United States Patent [19]

Schacht

[11] Patent Number: 4,676,682

[45] Date of Patent: Jun. 30, 1987

[54] MARKING MACHINE WITH TAG FEEDER

[76] Inventor: Roy A. Schacht, 744 Des Peres Rd., St. Louis, Mo. 63131

[21] Appl. No.: 874,872

[22] Filed: Jun. 16, 1986

Related U.S. Application Data

[63] Continuation of Ser. No. 661,693, Oct. 17, 1984, abandoned.

[51] Int. Cl.[4] ..... B41J 13/12

[52] U.S. Cl. ..... 400/628; 400/633; 101/43; 271/131; 271/240

[58] Field of Search ..... 414/125, 130, 131; 226/198, 199; 400/134, 134.1, 134.2, 134.3, 624, 628, 629, 633, 633.1, 633.2; 271/138, 139, 142, 144, 225, 240; 101/37, 43, 44

[56] References Cited

U.S. PATENT DOCUMENTS

| | | | |
|---|---|---|---|
| 20,039 | 4/1858 | Clarkson | 271/144 X |
| 553,159 | 1/1896 | Hollingsworth | 101/37 X |
| 1,069,958 | 8/1913 | Knurck | 400/628 |
| 1,170,214 | 2/1916 | Axelstrom | 493/351 |
| 2,463,690 | 3/1949 | Gruver | 400/134.3 |
| 2,528,435 | 10/1950 | Isett | 400/628 X |
| 2,699,862 | 1/1955 | Walter | 414/131 X |
| 2,954,976 | 10/1960 | Anderson et al. | 271/144 X |
| 3,896,983 | 7/1975 | Weirguni | 226/198 |
| 4,044,882 | 8/1977 | Weinke et al. | 400/903 X |
| 4,340,848 | 7/1982 | Hanagata et al. | 400/320 X |

*Primary Examiner*—Charles A. Pearson
*Attorney, Agent, or Firm*—Glenn K. Robbins

[57] ABSTRACT

A feeder device for feeding tags, cards, nameplates and the like to a rotary printer or marking machine. The feeder device is comprised of a chute for receiving a stack of tags. A reciprocatory pusher plate or shuttle is adapted to push a bottom-most tag through a narrow slot in a side wall of the chute onto a table of the printer. The table has a pair of guard rails spaced from one another and disposed in a converging relationship. The tags are pushed into a wide portion between the rails and advance into a tag engaging restricted portion between the rails where one of the rails is biasedly engageable against an edge of the tag. The tag is guided in a controlled manner as it is pushed underneath a printing wheel where the desired printing information is printed upon it.

17 Claims, 14 Drawing Figures

MARKING MACHINE WITH TAG FEEDER

This is a continuation of Ser. No. 661,693, filed Oct. 17, 1984, now abandoned.

BACKGROUND OF THE INVENTION

In the past various types of marking machines have been employed for marking on work pieces such as metal or plastic tags, cards or nameplates of one nature or another. Such marking or printing machines of the kind concerned in this invention have printing characters on the periphery of the marking wheel and are driven by a drive shaft to rotate the printing or marking wheel to a position where the selected printing character is directly superimposed over the tag or other work piece at which time the wheel or the tag are caused to bear against one another to effect the marking operation. Such marking machines are exemplified in my U.S. Pat. Nos. 4,322,173; 4,229,111 and 3,785,470.

Such tags or workpieces in the past have been fed manually to a work table for supporting the tag. Where the printing is done on a manual basis the manual tag feeding has not taken such a proportionately long period of time to present a significant factor. However, with the recent advent of high speed programmed printing of such tags which takes place at higher speeds the loss of time in manual feeding and requirement of operator attention and tie-up have presented significant time problems.

SUMMARY OF THE INVENTION

By means of this invention there has been an automatic feeder for feeding a tag, card, nameplate or other workpiece from a stack to a rotary printer without the requirement of operator attention. Once a stack of uniformly sized tags have been placed in a feeder chute and adjustments are made appropriate to the size of the tags a bottom-most tag may be automatically fed to the table of the printer where the desired information is printed and then followed by the feeding of another tag.

The tag feeder may be constructed as an adjunct to an existing printer for ready attachment or integrally as part of the printer housing. The feeder is comprised of a vertical chute adapted to receive a vertical stack of tags by adjustable side portions. The tags rest upon a floor and a pusher plate or shuttle is designed to push a bottom-most tag upon a work table of the printer by pushing the tag through a narrow slot, throat or gate in a side wall of the chute.

The pusher plate is reciprocally driven by a connection to an underlying pulley belt operated by a reversing motor. Energization may be effected by the conventional movement of the work table upon the completion of printing of one tag and movement of the table to a new or fresh tag printing position or by keyboard actuation as desired.

In a preferred embodiment the feeder is attached to a side of the printer housing. It is adjustably mounted in order that the tags may be fed in a flush manner to the work table. The tags are fed in sequence and as one tag is fed upon the table is pushes against a previously fed tag to present a working tag ready to be printed underneath the rotary printing wheel.

In another embodiment the tags are pushed from a tag chute positioned behind or in front of the line of travel of the tags upon the work table to the printer wheel. A stationary pusher bar plate is fixed to the printer housing to push the tags as they are fed to the table when the table moves upon the completion of a printing operation to position a new tag underneath the printer wheel.

In both embodiments guard rails are employed to control the path of travel of the tags upon the table and hold the tag to be worked or printed upon when it is positioned underneath the printer wheel. The guard rails are comprised of a fixed rear rail at a rear portion of the work table and an adjustable biased front rail. The front rail is adjusted to a slight converging relation with regard to the fixed rail to present a V-shaped or funnel-like configuration. The tags are loosely positioned in the wide mouth between the rails and are moved along by the pusher-plate to the converging and restricted portion between the guard rails. The tag to be printed is lightly held in biased engagement between the rails to withstand any vibration encountered in the printing operation.

Both the fixed guard rail and adjustable guard rail are provided with an overlying portion which receives the side edges of the tag and prevents vertical movement of the tags as they are fed across the work table. In effect a slot is provided by the two guard rails in which the front and rear edges of the tags are received and within which they are constrained while permitting sliding movement.

The automatic tag feeder may be used with a variety of rotary printing machines. It may be simply employed as an adjunct to existing machines or built integrally into the housing. Feeding may be effected as desired depending upon physical restraints from the side, front or rear. With the employment of the guard rails conventional flat surfaced work tables are efficiently utilized in the feeding operation.

The above features are objects of this invention. Further objects will appear in the detailed description which follows and will be further apparent to those skilled in the art.

For the purpose of illustration of this invention preferred embodiments thereof are shown in the accompanying drawing. It is to be understood that the drawing is for purpose of description only and that the invention is not limited thereto.

IN THE DRAWING

DESCRIPTION OF THE INVENTION

Figure 1:
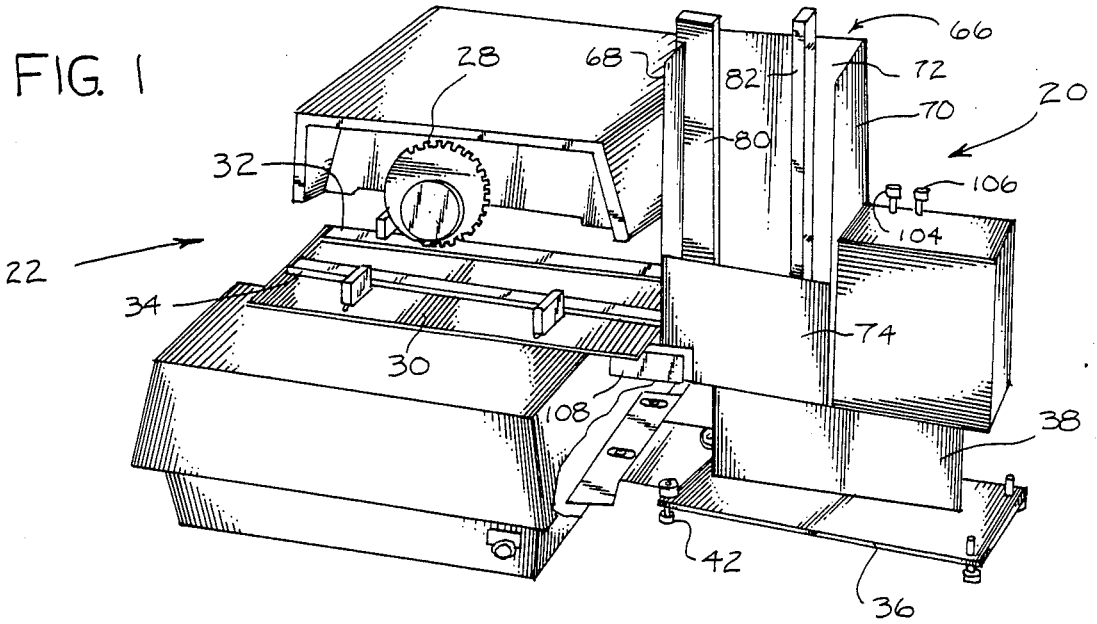
FIG. 1 is a pictorial view of the printer and feeder.

The automatic feeder of this invention is generally designated by the reference numeral 20 in FIG. 1 where it is shown attached to a rotary printer 22. The printer and feeder may be employed with a keyboard unit 24 and a video screen 26 as shown in FIG. 2.

The rotary printer is of the same general type as disclosed in my afore-mentioned patents and is comprised of a motor driven rotary printing wheel 28 having print characters on the periphery. A work table 30 receives underneath the printing wheel the tags, cards, nameplates or the like to be printed. A pair of guide rails comprised of a fixed rear rail 32 and an adjustable forward rail 34 are supported upon the work table to guide the tags as they are fed.

Figure 2:
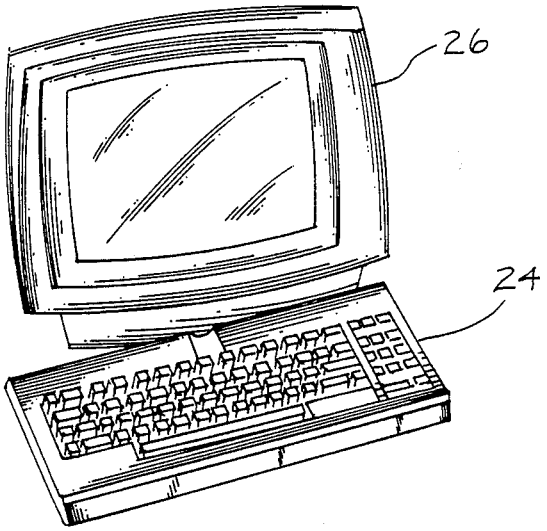
FIG. 2 is a pictorial view of a keyboard and video screen employed in operating the printer and feeder.

The keyboard 24 shown in FIG. 2 forms no part of this invention, per se, and may be of conventional construction with separate keys for each of the characters or numerals employed on the printing wheel 28 and appropriate controls for operating the work table in so-called X-Y movement in the plane of the work table for desired presentation of the tag to be printed. The video screen likewise forms no part of the invention, per se, and may be used for display of stored information for nametag identification, retention of tag physical parameters and the like as required. A memory control or microprocessor unit, (not shown) may also be employed to store various programs for printing different types of tags for various customers or other purposes.

Figure 5:
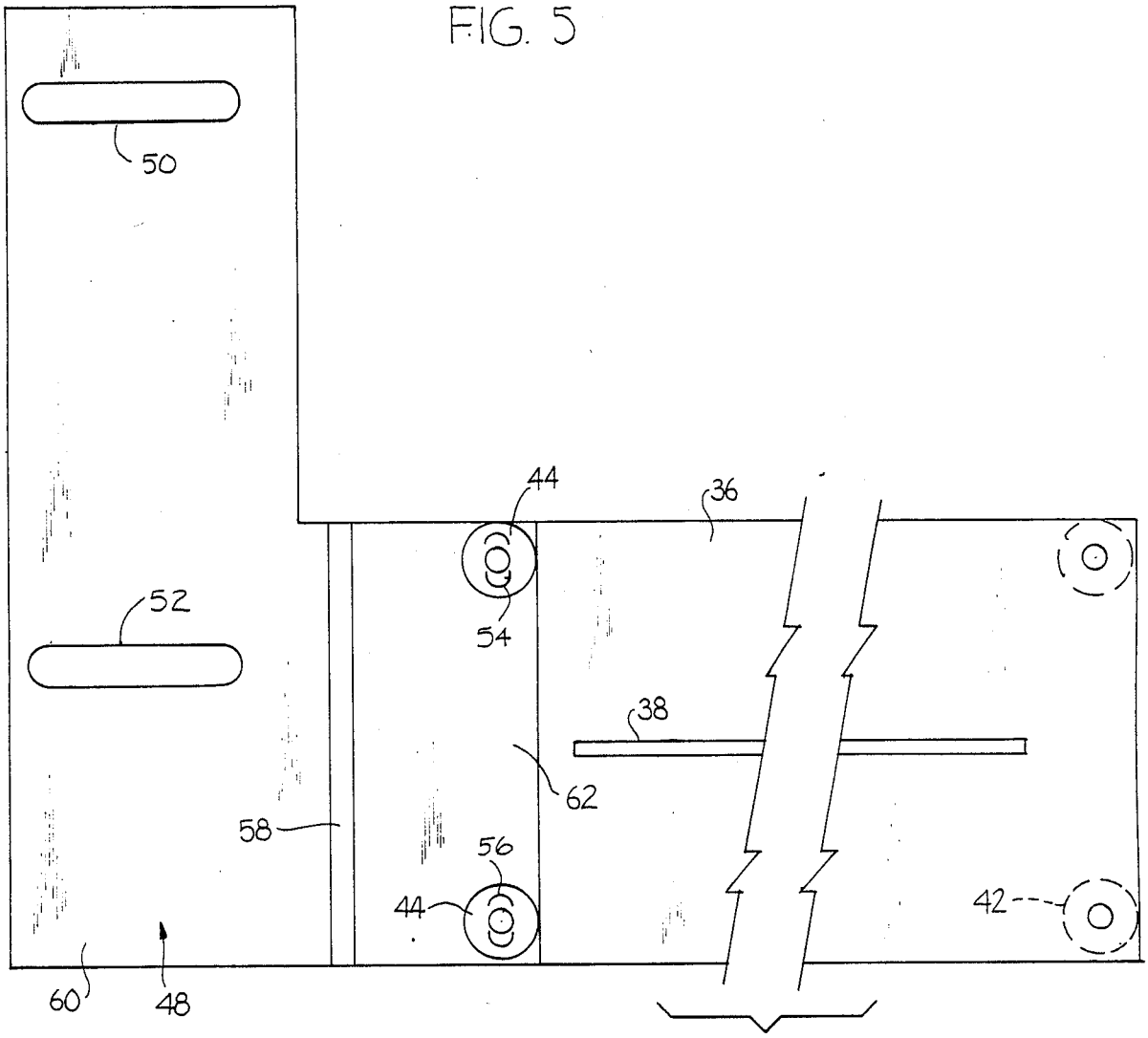
FIG. 5 is an enlarged fragmentary top plan view showing a connecting plate and adjustment mechanism for connecting the feeder to the printer.
Figure 6:
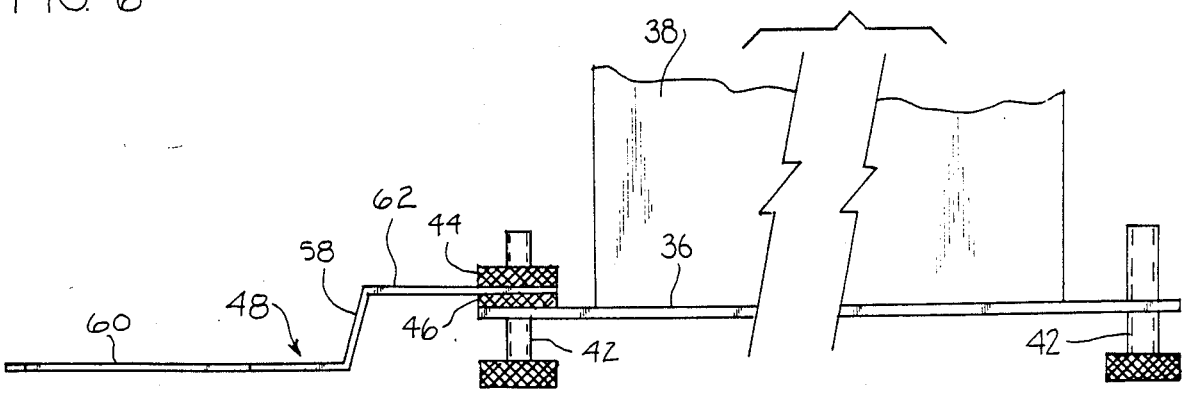
FIG. 6 is a view in front elevation of the connecting plate and adjustment mechanism of FIG. 5.

The feeder 20 is comprised of an adjustable base 36 having an intermediate support web 38 and a floor 40 which supports the operative components of the tag storage and feeder mechanism to be described. The base as best shown in FIGS. 1,5 and 6 is supported upon adjustable feet 42 in order to provide for height adjustment and leveling of the floor 40 with respect to the plane of the work table 30.

The adjustable feet 42 are comprised of threaded knurled bolts which are threadedly received in threaded holes in the base 36. Protruding ends of the bolts are employed with nuts 44 and 46 to secure a connecting and positioning plate 48 which is fastened at an opposite side of the plate to bolts (not shown) on the housing of the printer 22 as shown in FIG. 1. Elongated slots 50 and 52 provide for moving the connecting plate and feeder unit toward and away from the printer and work table while elongated slots 54 and 56 provide for moving the feeder unit forwardly and rearwardly with respect to the printer and work table. An intermediate bend portion 58 in the connecting plate between a horizontal printer connecting portion 60 and a horizontal feeder connecting portion 62 permits raising and lowering of the feeder unit with respect to the printer while maintaining desired rigidity and stability in a horizontal plane.

The floor 40 is formed of an inverted channel shaped member mounted upon cross-blocks 64 connected to the top part 65 of the base 36. The floor 40 is spaced above the top part of the base to provide room for a pulley belt drive mechanism for the tag pusher plate or shuttle as will be described.

Figure 3:
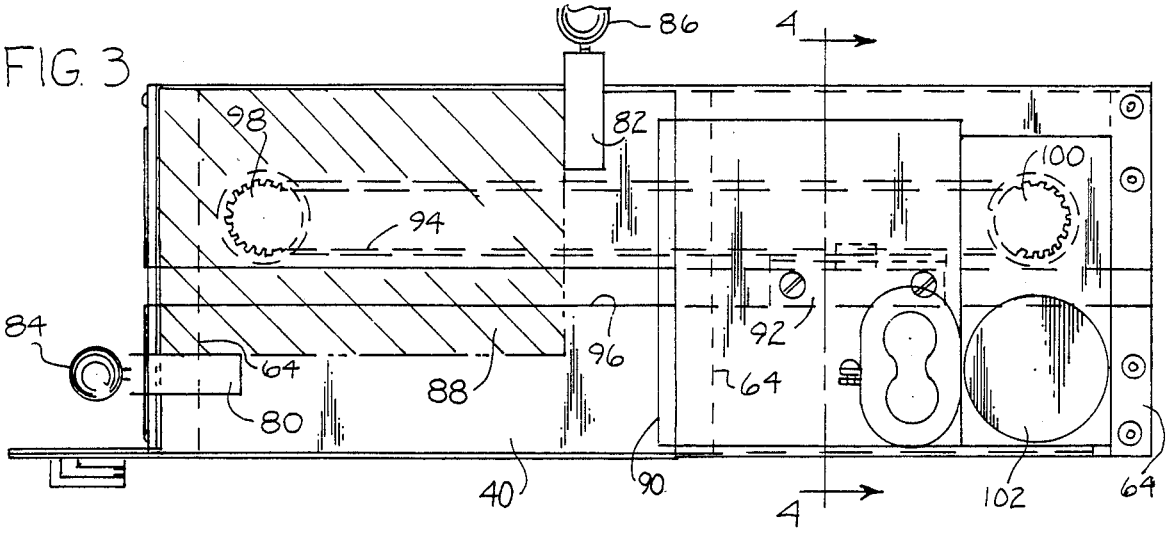
FIG. 3 is a top plan view of the feeder.
Figure 4:
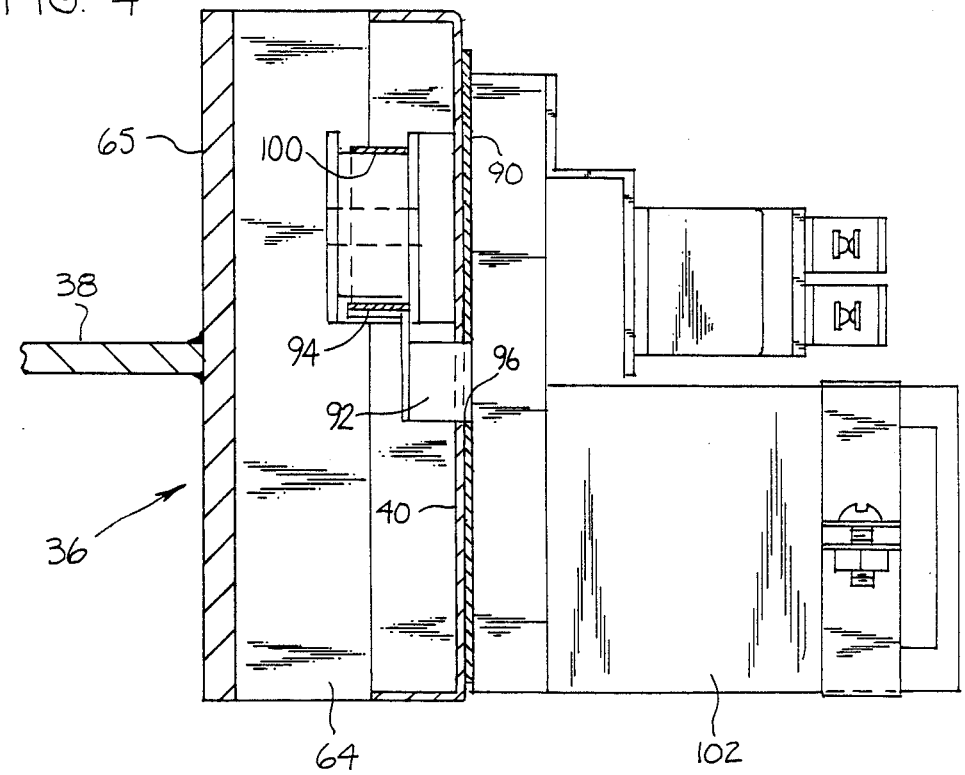
FIG. 4 is an enlarged view in section taken on the line 4—4 of FIG. 3.
Figure 9:
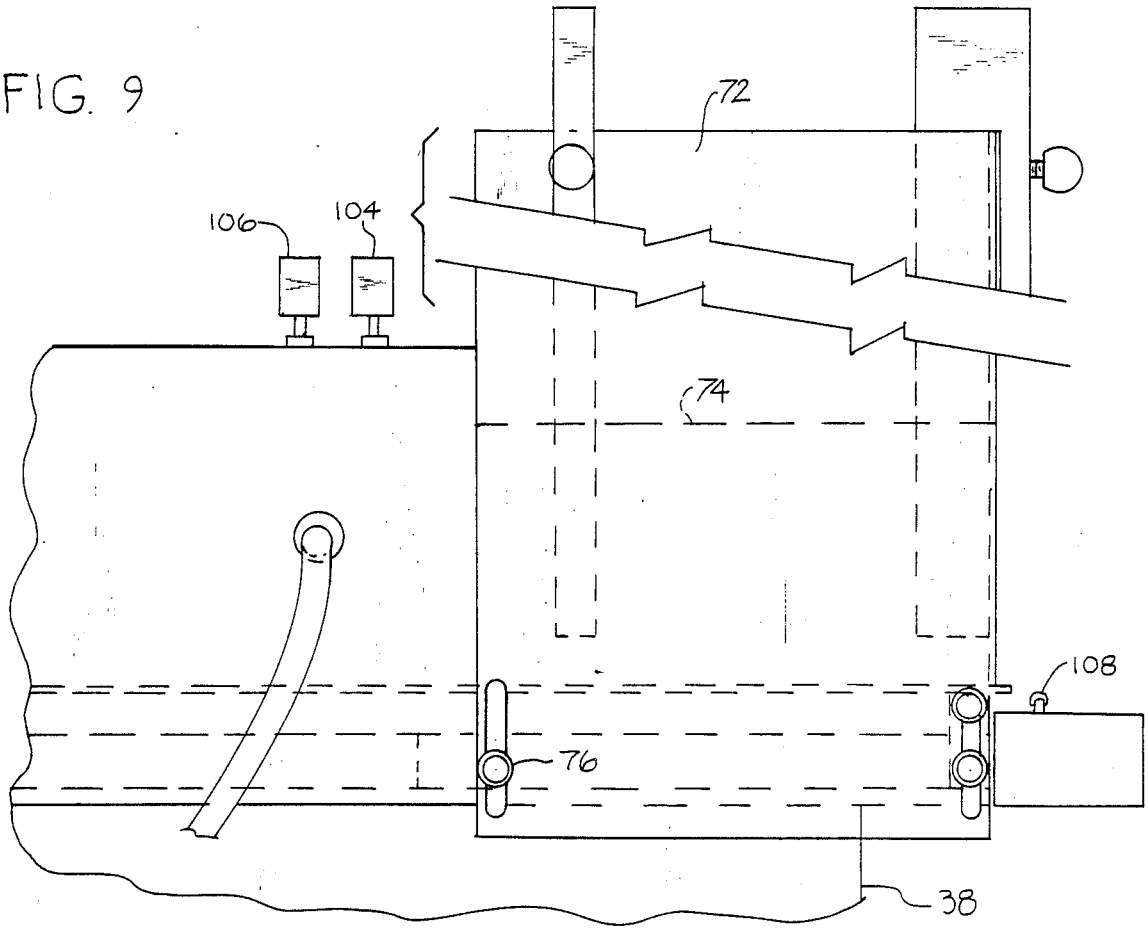
FIG. 9 is an enlarged fragmentary view in left side elevation of the front of the feeder.
Figure 10:
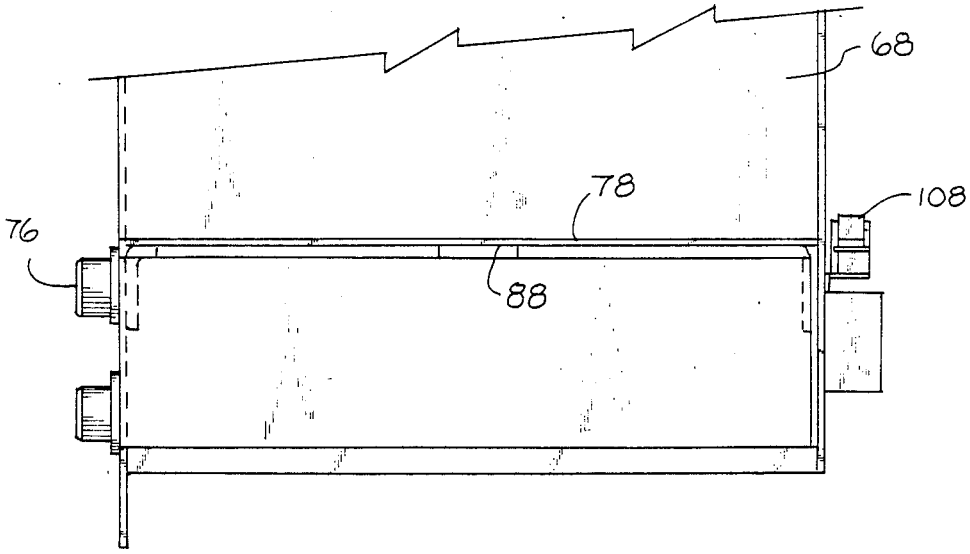
FIG. 10 is an enlarged fragmentary view in front elevation of the feeder chute and throat.

In order to store the tags to be fed a vertically extending chute 66 as best shown in FIGS. 1 and 3 is provided. The chute is connected to the feeder base 36 and extends above the floor 40. It is comprised of a front wall 68, rear wall 70 and side walls 72 and 74. Side wall 74 is shorter than the other walls to afford easy access for tag loading upon the floor. The walls 68, 70 and 72 are formed integrally to form a channel shaped structure. The front and rear walls terminate above the floor to provide room for tag ejection and movement of the pusher plate, respectively. The side wall 72 as shown in FIG. 9 extends below the floor 40 and is connected to the base support block 64 by adjustment screws 76 interfitted through slots in the wall which permit the integral chute walls 68, 70 and 72 to be raised and lowered with respect to the floor 40. This provides an adjustable throat 78 for passage of the fed bottom-most tag as it is moved from the chute. The throat is defined by the floor and the bottom edge of the spaced front wall 68 and is made adjustable in height to accommodate tags of different thickness.

The chute is further provided with J-shaped tag support bars 80 and 82 which fit over the front wall 68 and side wall as shown in FIGS. 1 and 3. Thumb screws 84 and 86 provide for tightening the bars against the walls. The support bars are adjustable to accommodate a boundary for different sized stacks of tags 88 which are confined between the front wall 68, side wall 72 and the afore-mentioned support bars.

The feed mechanism for feeding a bottom-most tag 88 from the tag stack comprises a pusher plate 90 which is reciprocally driven on top of the floor 40 by a shuttle slide block 92 connected to the bottom of the pusher plate and a motor driven reversibly pulley belt 94 fastened to the slide block. The slide block fits through a narrow elongated track like opening 96 in the floor as a guide.

The pulley belt is of a toothed construction and is positioned underneath the floor. It fits around a toothed idler pulley 98 and a toothed drive pulley 100. The drive pulley is driven by a conventional drive shaft (not shown) of a reversible stepping motor 102. The stepping motor is adjustable in a forward drive position to advance the drive train comprising the drive pulley 100, the pulley belt 94, the shuttle slide block 92 and the pusher plate 90 by a conventional forward adjustable control knob 104 and in the reverse direction by a control knob 106. In this manner the stroke of the pusher plate may be adjusted to accommodate different sizes of tag stacks stored in the tag chute 66.

In order to activate the motor 102 in the forward drive position and the drive train to the pusher plate 90 and feed the bottom-most tag 88 to the printer work table 30 a limit switch 108 is employed. The limit switch as shown in FIG. 1 is mounted at the front of the feeder 20 in the path of the work table when it is moved to the right for a fresh print on a new tag after a tag has been printed.

Figure 7:
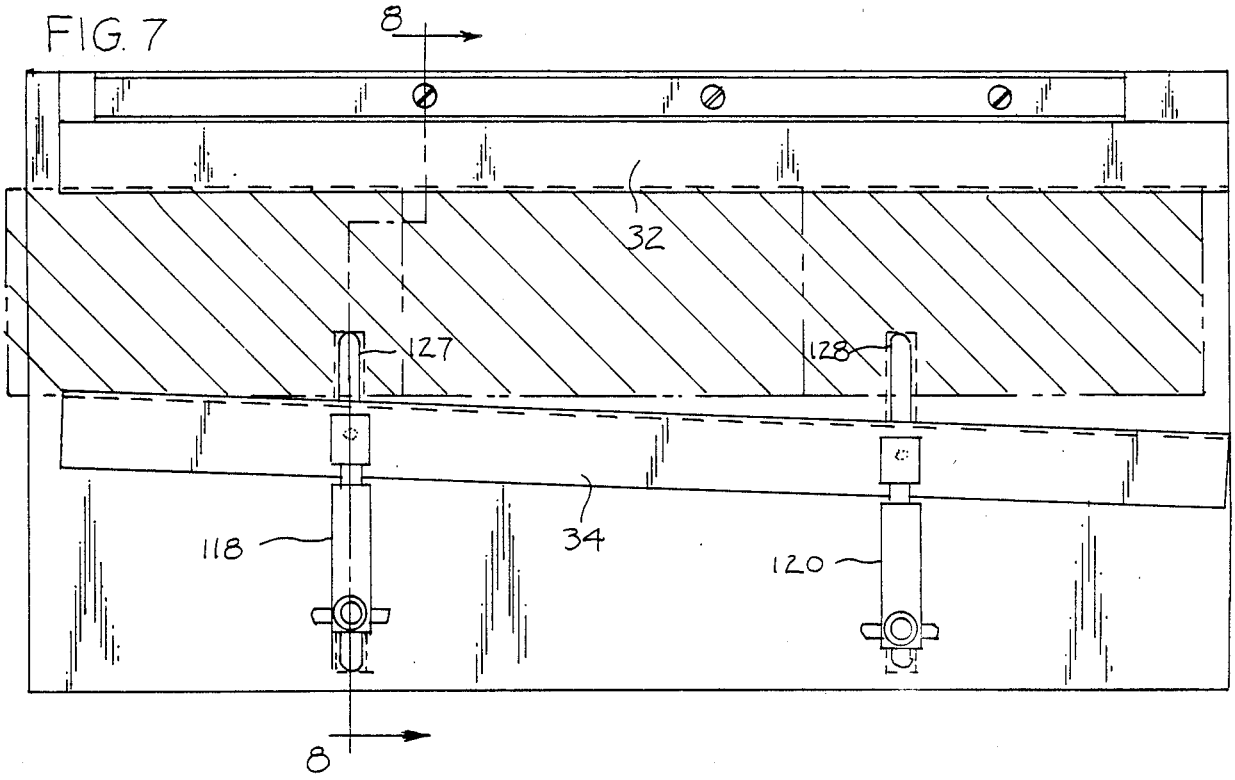
FIG. 7 is a top plan view of the table and plate holding mechanism.
Figure 8:
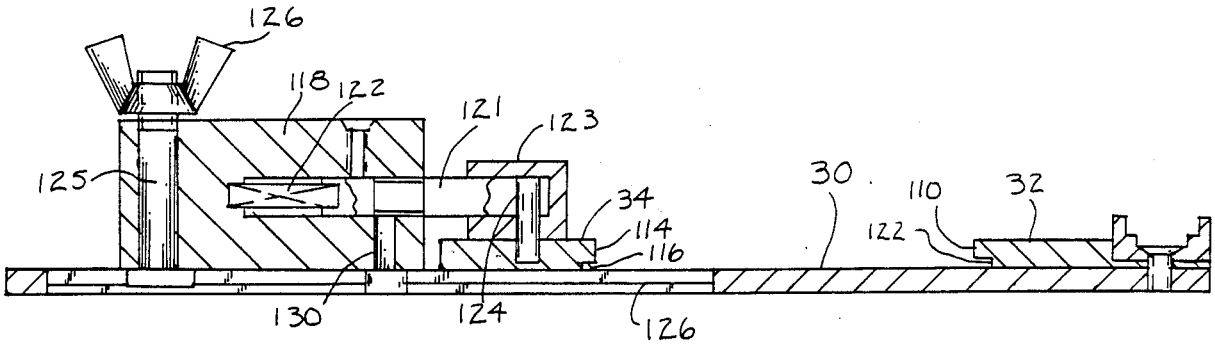
FIG. 8 is an enlarged view in section taken on line 8—8 of FIG. 7.

In order to guide and position the tags as they are fed to the work table the fixed rear guide rail 32 and biased front guide 34 are employed. Their construction is best shown in FIGS. 1, 7 and 8.

The rear guide rail 32 is fixed to the work table and has an overhang portion 110 defining a notch or slot 112 underneath which receives the rear edge of a tag to maintain the tag flat upon the work table.

The forward adjustable guide rail 34 has a similar overhang portion 114 and notch or slot 116 to receive the front edges of the tags as they advance between the guide rails.

In order to provide for adjustment and biasing of the front guide rail a pair of adjustable biasing blocks 118 and 120 are employed. Each of the blocks receives one end of a biasing rod 121 biased by spring 122 while the opposite end is received in fitting 123 pivotally connected by a pin 124 to the top of the front guide rail. Each of the blocks is further provided with adjustment pins 125 tightened by wing nuts 126. The pins fit through a pair of parallel slots 127 and 128 extending from the front to the rear of the work table. A guide pin 130 depends from each of the blocks into the slot and with the pins 125 serve to guide and retain the blocks 118 and 120 within the slots which serve as tracks. By the afore-mentioned construction the front guide rail 34 may be moved forwardly and rearwardly on the work table and angularly displaced with respect to the rear guide rail 32 to accommodate different sized tags and vary the width of the mouth of the funnel shaped area between the two guide rails.

Figure 11:
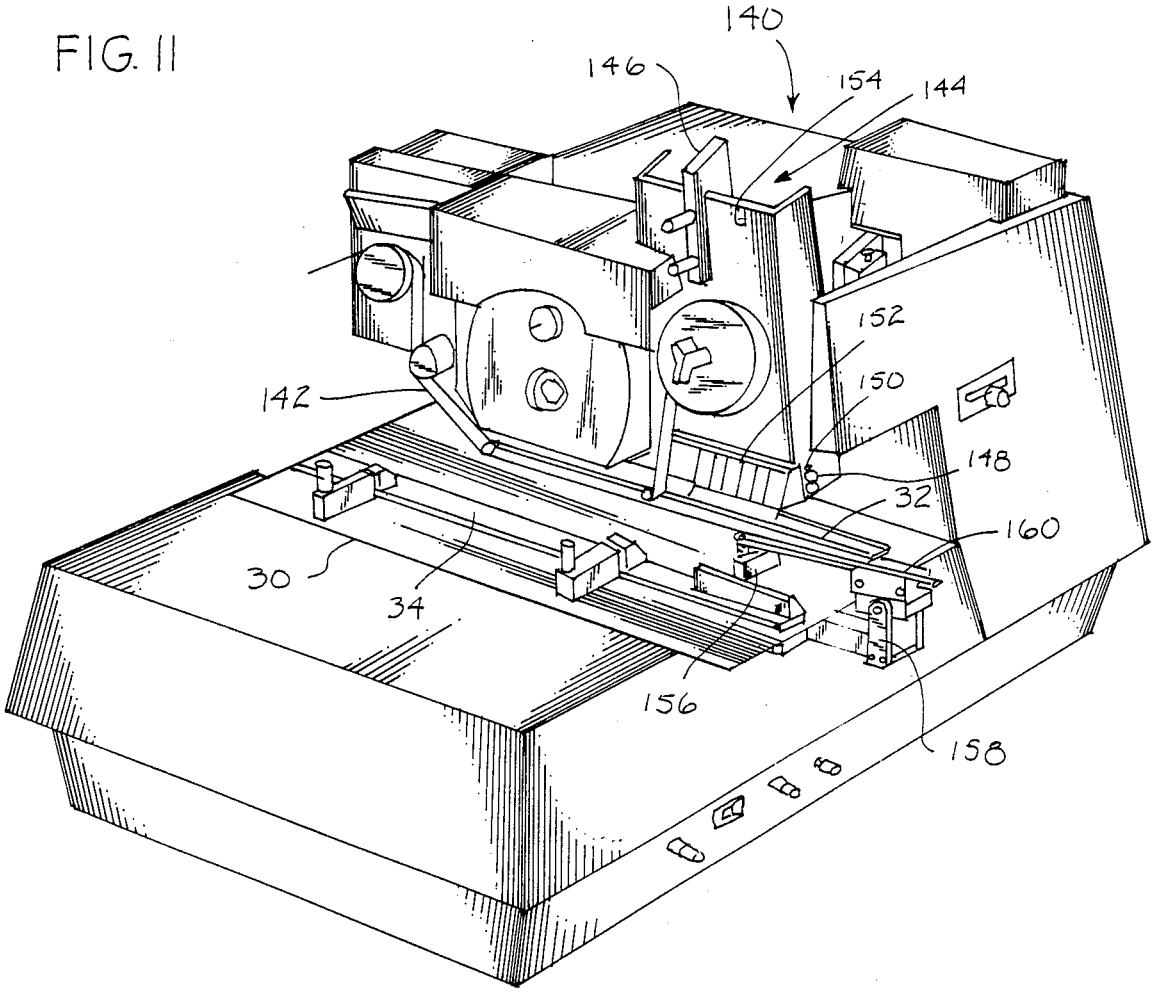
FIG. 11 is a pictorial view of a modified printer and rear feeder using a stationary pusher.

A modified feeder 140 is shown in FIG. 11. It is employed in the same type of rotary printer as generally described in FIGS. 1 and 2. It employs the same work table 30 and guide rails 32 and 34. It may be used with so-called hot branding tape 142 which forms no part of this invention but is shown simply to describe the versatility of rotary printers that may be used.

The feeder 140 is integrally constructed with the printer housing. It employs a chute 144 with an adjustable bar 146 for accommodating different widths of tags. The floor, drive train including reversible stepping motor, pulley belt and pulleys and connection to a reversible pusher plate are similar in construction to that previously described. The chute may be raised and lowered by tightening nuts 148 fitting in a slot 150 in the side of the chute to narrow or widen a throat 152 between a floor of the feeder and a front wall 154 of the chute similarly to that of the feeder 20 of FIG. 1.

The chute 144 and floor of the feeder are tilted toward the front of the printer in order to drop feed the tag upon the work table between the guide rails and at right angle to the axis of the path between the guide rails. Similar limit switches are employed to activate the feeder drive mechanism as previously described.

The dispensing of the tags upon the work table is in a different direction as noted than the in-line dispensing of the feeder 20 of FIG. 1. In the embodiment of feeder 20 the pusher plate 90 pushes the tag into the line of tags 88 between the guide rails and the advancement of the tags to present a fresh tag to be printed under the printer wheel is effected by the pusher plate pushing against the line of tags or the movement of the work table to the right as desired. In the modified feeder 140 a stationary pusher bar 156 is mounted between the guide rails which acts as a stop for the tags when the work table 30 is moved to the right. The tags are displaced in effect to the left of the work table as the table moves to the right.

The pusher bar 156 is mounted upon a support bracket 158 connected to a housing of the printer. An adjustment rod 160 is mounted between the bracket and the pusher bar and may be shortened or lengthened to accommodate different sizes of tags.

Figure 12:
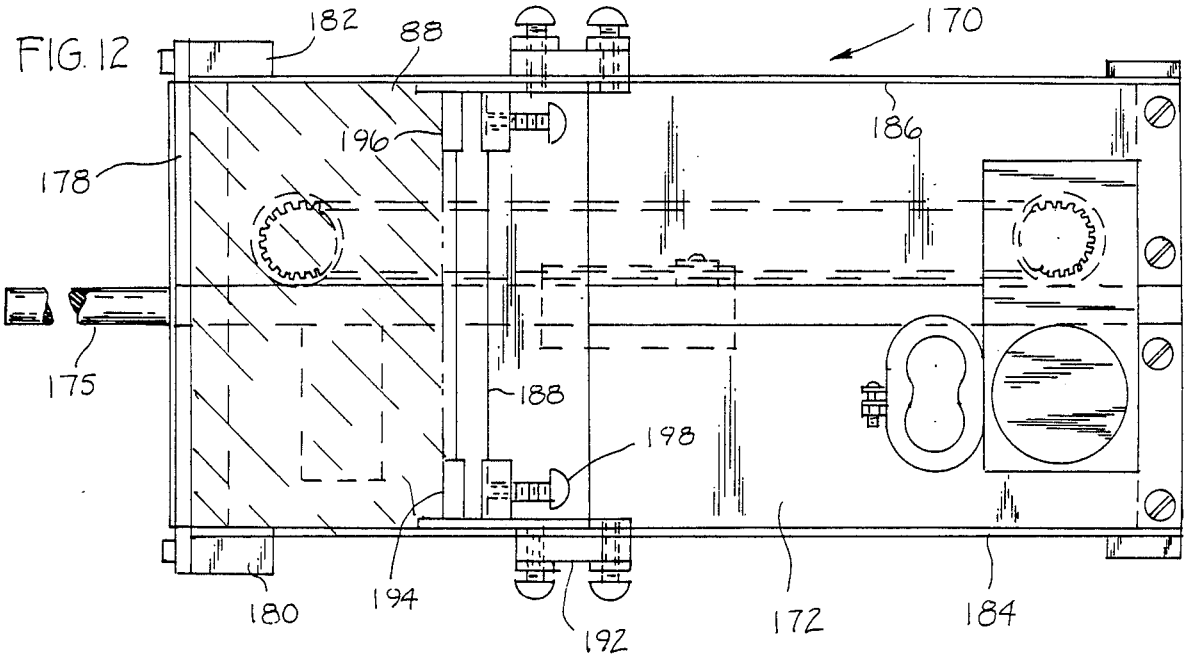
FIG. 12 is a top plan view of a further modified front feeder.
Figure 13:
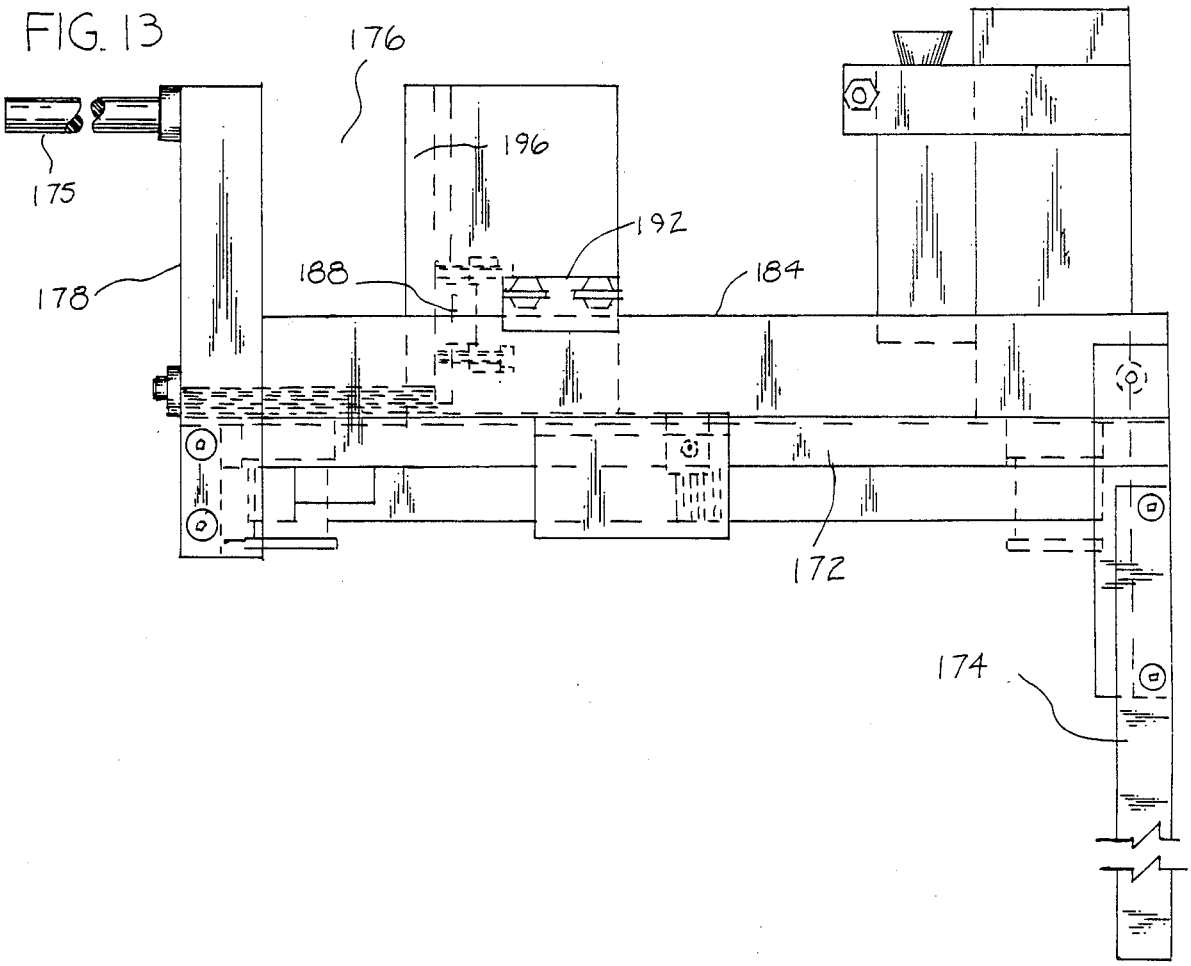
FIG. 13 is a view in side elevation of the modified feeder taken from the right side of FIG. 12.
Figure 14:
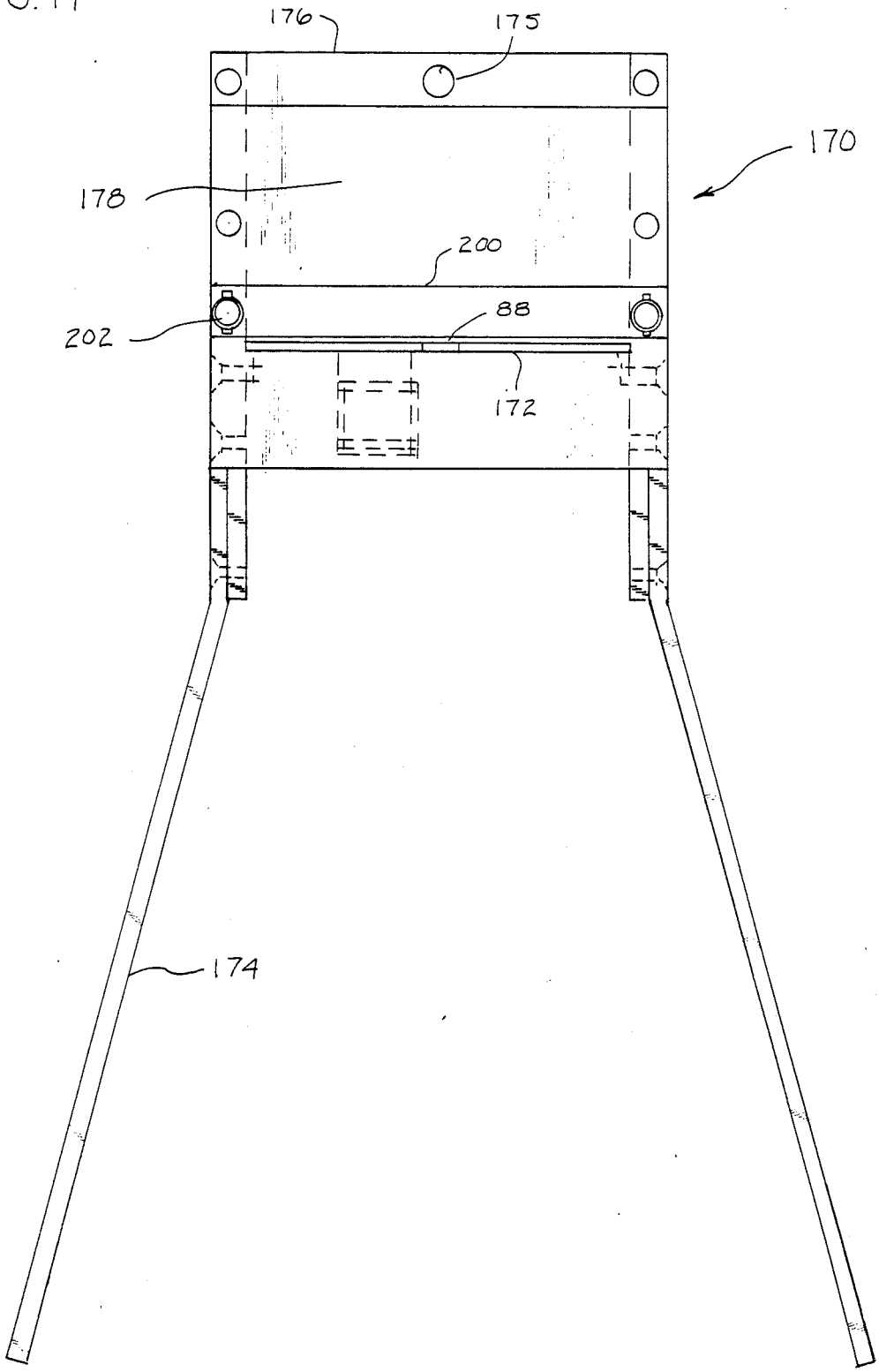
FIG. 14 is a view in front elevation of the modified feeder of FIG. 12.

A further modified feeder 170 is shown in FIGS. 12, 13 and 14. This feeder is adapted to be used as an adjunct to an existing printer 22 in FIG. 1 but feeds the tags at right angles to the path of feed between the guide rails 32 and 34 similarly to feeder 140 of FIG. 9. It employs a stationary pusher bar as described for feeder 140 and employs the same work table 30.

The feeder 170 may be positioned at the front or rear of the printer and employs a drop feed dispensation of the tag upon the work table between the guide rails. The feeder is comprised of a floor 172 from which at the rear depend a pair of legs 174. A support rod 175 extends forwardly at the front of the feeder and with the legs is employed for supporting the feeder against the printer and upon a support surface in canted or tilted relation which may be to the left or somewhat counterclockwise to the position shown in FIG. 13.

A chute 176 for storing tags is comprised of a front chute wall 178 connected to upright supports 180 and 182 extending above the floor. Side walls 184 and 186 extend above the floor from the front to the rear of the feeder. An adjustable tag support bar 188 is moveable forwardly and rearwardly along the floor and may be locked by thumb screws 190 which tighten a slide block 192 which is connected to the support bar. The slide block rides along the top edge of each of the side walls which serves as a track.

The tag support bar 188 serves as an adjustable stop to accommodate tags of different length. A pair of tag support uprights 194 and 196 serve to support the corners of the tags as shown in FIG. 12. They are slidably mounted on the support bar 188 and may be locked in adjusted position by lock screws 198.

The drive mechanism comprising the stepping motor, drive pulley, pulley belt, slide block and pusher plate is similar to that previously described. A throat bar 200 adjustably connected to the uprights 180 and 182 by bolts 202 is employed for moving the bottom edge of the front wall boundary of the chute to accommodate different tag thicknesses. Limit switches may be employed in a similar fashion to that previously described.

USE

The feeder 20 shown in FIGS. 1–8 is simply employed with a conventional rotary printer 22. The printer may have its own keyboard or use a separate keyboard 24 and video screen 26. The installation of the feeder unit is simply effected by attaching one side of the plate 48 to the printer housing. This is effected by fitting bolts secured to the housing through the slots 50 and 52 and tightening nuts thereagainst.

The connecting plate 48 is then connected to the adjustable feet or legs 42 of the feeder 20. Adjustment to the proper height is effected by levelling and adjustment nuts 44 and 46. The height elevation of the floor 90 of the feeder is effected to level it with the table 30 or a very slight distance above the table to provide a flush relationship. The bend 58 in the connecting plate and the transverse position of the slots 50–52 and 54–56 facilitates the proper alignment of the feeder unit to discharge tags between the guide rails 32 and 34 and correct height adjustment.

Once the feeder unit has been connected the chute 66 is loaded with a stack of uniform sized tags and the tag support bars 80 and 82 are squared up against the sides of the tag. The biased guide rail is then adjusted with respect to the fixed rail to present a slightly converging path from the right side of the table where the tags are ejected from the feeder to the printing position underneath the rotary printing wheel 28. The path progresses from a wide mouth somewhat wider than the tags ejected to a constricted area slightly less than the height of the tags in order that the guide rail be lightly biased against the tag to stabilize it in the print position.

With the chute loaded and the guide rail 34 adjusted the feeder unit is ready for use after the forward and reverse strokes of the pusher plate 90 and drive train comprising the reversible stepping motor 102, pulley belt 94 and pulley slide block 92 are set. This is effected by adjustment of the motor control switches 104 and 106. This adjustment is set to correspond to the length of the tags 88 stored in the chute.

In operation the tags may be manually loaded in a string on the work table 30 as shown in FIG. 1 or the feeder unit may be activated from the keyboard to run the stepping motor 102 through several repeat cycles until the path between the guide rails 32 and 34 has been filled to present a tag underneath the printing wheel in the print position.

The tags 88 are fed from the chute in the forward position by the contact of the pusher plate 90 with a bottom tag. As the tag is ejected through the adjustable throat 78 the leading edge of the ejected tag pushes against the last tag on the work table and forces the entire string between the guide rails to present a fresh tag in the print position underneath the printing wheel. The tag previously printed is discharged off the work table for collection. Upon completion of the forward stroke the pusher plate is returned by the reversal of the drive train and moved from underneath the tag chute to present a new tag for the next feeding cycle.

The operation of the feeder unit may be automatically started by the movement of the work table 30 in a so-called "return" operation upon the completion of a tag printing. Upon operation of a conventional work table return key on the keyboard the table is moved to the right to engage the limit switch 108 to activate the motor 102 and commence the tag feeding cycle as above described.

The modified feeder 140 of FIG. 11 operates in a similar manner to that of the feeder 20 except that it is integrated into the printer housing and the feed is from the rear of the work table 30 and a stationary pusher bar 156 is employed. In this operation the chute is loaded in much the same fashion as previously described and the tags are similarly squared. The pusher plate and drive train operate in a similar manner.

The ejection of the tags takes place by feeding the tags through the throat and dropping upon the work table 30 in the wide mouth passage between the guide rails 32 and 34 in front of the pusher bar. The stationary pusher bar is adjusted by adjustment rod 160 to an appropriate setting corresponding to the length of the tags 88.

When a tag is desired to be fed the drive train of the feeder is operated by conventional actuation from the keyboard to drop a tag upon the work table. The work table 30 is then operated to move it to the right in the "return" position. As the work table moves to the right the fed tag is constrained by the pusher bar between the guide rails 32 and 34 and is displaced by the stationary pusher bar 156 to the left upon the work table. The return of the pusher plate upon reversal of the drive train completes the feeding cycle. When the work table is moved to the left it is cleared to receive a fresh tag in another cycle. Repeated movement of the feeding cycle and work table may be employed to establish a string of tags in commencing the operation or manual placement may be effected as desired. Upon completion of a tag printing and subsequent feeding the printed tag is discharged from the work table for collection.

The further modified feeder 170 of FIGS. 12, 13 and 14 operates in a similar manner to that of feeder 140 of FIG. 11 except that it is an adjunct to an existing printer and feeds the tags from the front of the work table. The drive train for the feeder pusher plate and the floor and chute structure are the same as in the previous embodiments. A stationary pusher bar is employed as in the feeder 140 of FIG. 11.

The feeder is mounted on legs 174 upon a support base and is canted against the printer housing by support bar 175 in such a manner that the floor is tilted downwardly to discharge the tags 88 and drop them upon the work table. The tags are stacked in the chute 176 and squared by tag support bar 188 and uprights 194 and 196 which are tightened by lock screws 198.

The forward and reverse cycle of the pusher plate is the same as that in feeder 140. The stationary pusher bar 156 likewise is used in the same fashion.

Various changes and modifications may be made within this invention as will be apparent to those skilled in the art. Such changes and modifications are within the scope and teaching of this invention as defined in the claims appended hereto.

What is claimed is:

1. A tag feeder for marking machines having a rotary marking wheel having marking characters on the periphery of the wheel adapted to be moved into marking contact with an underlying work table having means for moving in an X-Y relation, said tag feeder comprising a floor for supporting a stack of tags to be fed from a chute extending above said floor, a pusher plate means comprising a pusher plate slidably supported upon said floor, reciprocatory drive means for driving said pusher plate along and on top of said floor and through said chute into engagement with the rear of the stack of tags to engage and feed a bottom-most tag through a slot in the chute and upon said work table between a pair of guide rails, said pusher plate having a front engageable in abutting relation with said bottom-most tag and being driveable through said slot to move said tag completely out of the chute and upon the work table to form a string of tags thereupon, means for connecting said guide rails to said work table, said guide rails being of sufficient length for defining a feed path for the string of tags across the work table in an X-direction from adjacent the chute to underneath said marking wheel, one of said guide rails being fixed on the work table and the other of said guide rails being supported independently of said chute upon said table in a slanted biased converging relation with said fixed rail and being laterally and pivotally moveable with respect to said fixed rail to accommodate different sized strings of tags and vary the converging relation, the other of said guide rails being rigid and being biased throughout toward said fixed rail, said converging relationship establishing a funnel shaped feed path for said tags that is wider adjacent the chute than adjacent the marking wheel.

2. The tag feeder of claim 1 in which said adjustable biasing means comprises a pair of blocks separately adjustable upon the work table in a Y-direction and means for pivotally connecting each of said blocks to said adjustable guide rail to provide a varying converging relation of the adjustable guide rail to the fixed rail.

3. The tag feeder of claim 2 in which said adjustable guide rail is pivotally connected to each of said blocks by a biasing rod whereby the tags as they are fed underneath the marking wheel may be gripped in a restrained biased relation.

4. The tag feeder of claim 1 in which means are provided in said chute for squaring stacks of tags of different sizes, said means comprising adjustable support bars supported within said chute and engageable with sides of said stack of tags for squaring said tags against inner walls of said chute.

5. The tag feeder of claim 1 in which said floor extends underneath said chute and to the rear thereof a sufficient distance to support the pusher plate for movement from underneath said chute and to the rear thereof and said floor has a longitudinally extending slot slidably receiving an underlying slide block connected to an underside of said pusher plate and said reciprocatory drive means.

6. The tag feeder of claim 5 in which said drive means is comprised of a reversible stepping motor operably connected to said slide block.

7. The tag feeder of claim 6 in which the feeder is provided with a limit switch responsive to engagement by the work table to actuate said stepping motor.

8. The tag feeder of claim 1 in which said tag feeder comprises a base support for said floor, said base support being supported on a work surface base independent of said marking machine and connecting means are provided for rigidly connecting said base support to said marking machine.

9. The tag feeder of claim 8 in which said base support is provided with work surface base engaging leveling screws to provide both levelling and vertical adjustment.

10. The tag feeder of claim 8 in which said connecting means comprises a substantially rigid plate rigidly connected at one side to said marking machine and at another side rigidly connected to said base support to fix X-Y movement.

11. The tag feeder of claim 8 in which said base support is vertically adjustable with respect to said work surface base upon which said base support is mounted to provide a substantially flush relation of said floor to the work table and said base support is provided with work surface base engaging leveling screws to provide both leveling and vertical adjustment.

12. A tag feeder for marking machines having a rotary wheel having marking characters on the periphery of the wheel adapted to be moved into marking contact with an underlying work table having means for moving in an X-Y relation, said tag feeder comprising a floor for supporting a stack of tags to be fed from a chute extending above said floor, a pusher plate means comprising a pusher plate slidably supported upon said floor, reciprocatory drive means for driving said pusher plate along said floor and through said chute into engagement to feed a bottom-most tag through the chute and upon said work table between a pair of guide rails having means for connecting said guide rails to said work table, said guide rails defining a feed path across the work table in an X-direction underneath said marking wheel, tag pushing means for moving said tags upon the work table between said guide rails in an X-direction to establish a string of said tags thereupon extending from the feeder to underneath the marking wheel for ejection from the work table on a side thereof opposite to the feeder, the pusher plate feeding the bottom-most tag upon the work table in a Y-direction and said tag pushing means comprising a pusher bar mounted above said work table in slidable relation therewith and engageable with said tag as the work table is moved in an X-direction to push the tag along the work table between said guide rails.

13. The tag feeder of claim 12 in which said pusher bar is adjustably supported in an X-direction with respect to said work table to accommodate tags of different lengths.

14. A tag feeder for marking machines having a rotary marking wheel having marking characters on the periphery of the wheel adapted to be moved into marking contact with an underlying work table having means for moving in an X-Y relation, said tag feeder comprising a floor for supporting a stack of tags to be fed from a chute extending above said floor, a pusher plate means comprising a pusher plate slidably supported upon said floor, reciprocatory drive means for driving said pusher plate along and on top of said floor and through said chute into engagement with the rear of the stack of tags to engage and feed a bottom-most tag through a slot in the chute and upon said work table between a pair of guide rails, said pusher plate having a front portion engageable in abutting relation with said bottom-most tag and being driveable through said slot to move said tag completely out of the chute and upon the work table to form a string of tags thereupon, means for connecting said guide rails to said work table, said guide rails defining a feed path across the work table in an X-direction underneath said marking wheel, one of said guide rails being fixed on the work table and the other of said guide rails being supported upon said table in a slanted biased converging relation with said fixed rail and being laterally and pivotally moveable with respect to said fixed rail to accommodate different sized strings of tags and vary the converging relation, said converging relationship establishing a funnel shaped feed path for said tags that is wider adjacent the chute than adjacent the marking wheel, said floor extending underneath said chute and to the rear thereof a sufficient distance to support the pusher plate for movement from underneath said chute and to the rear thereof and said floor having a longitudinally extending slot slidably receiving an underlying slide block connected to an underside of said pusher plate and said reciprocatory drive means, said drive means being comprised of a reversible stepping motor operably connected to said slide block, said reversible stepping motor being connected to a toothed drive pulley, a toothed pulley belt being engageable between said drive pulley and a toothed idler supported underneath said floor and said slide block being connected to said pulley belt.

15. The tag feeder of claim 14 in which adjustment means are provided for regulating a forward and reverse cycle of said motor to vary a forward and reverse stroke of said pusher plate to accommodate different sized tags.

16. A tag feeder for marking machines having a rotary marking wheel having marking characters on the periphery of the wheel adapted to be moved into marking contact with an underlying work table having means for moving in an X-Y relation, said tag feeder comprising a floor for supporting a stack of tags to be fed from a chute extending above said floor, a pusher plate means comprising a pusher plate slidably supported upon said floor, reciprocatory drive means for driving said pusher plate along and on top of said floor and through said chute into engagement with the rear of the stack of tags to engage and feed a bottom-most tag through a slot in the chute and upon said work table between a pair of guide rails, said pusher plate having a front portion engageable in abutting relation with said bottom-most tag and being driveable through said slot to move said tag completely out of the chute and upon the work table to form a string of tags thereupon, means for connecting said guide rails to said work table, said guide rails defining a feed path across the work table in an X-direction underneath said marking wheel, one of said guide rails being fixed on the work table and the other of said guide rails being supported upon said table in a slanted biased converging relation with said fixed rail and being laterally and pivotally moveable with respect to said fixed rail to accommodate different sized strings of tags and vary the converging relation, said converging relationship establishing a funnel shaped feed path for said tags that is wider adjacent the chute than adjacent the marking wheel, said tag feeder comprising a base support for said floor, said base support being supported on a work surface independent of said marking machine and connecting means being provided for rigidly connecting said base support to said marking machine, said connecting means comprising a substantially rigid plate rigidly connected at one side to said marking machine and at another side rigidly connected to said base support to fix X-Y movement, said connecting means being provided with means for adjusting said base support to said marking machine in an adjustable X-Y relation, said last named means comprising a pair of slots at one side of said plate extending in an X-direction and a second pair of slots extending in a Y-direction at a second side of said plate and connecting screws fitting through said slots for connecting said plate to the marking machine and the base support.

17. A tag feeder for marking machines having a rotary marking wheel having marking characters on the periphery of the wheel adapted to be moved into marking contact with an underlying work table having means for moving in an X-Y relation, said tag feeder conprising a floor for supporting a stack of tags to be fed from a chute extending above said floor, a pusher plate means comprising a pusher plate slidably supported upon said floor, reciprocatory drive means for driving said pusher plate along and on top of said floor and through said chute into engagement with the rear of the stack of tags to feed a bottom-most tag through the chute and upon said work table between a pair of guide rails, means for connecting said guide rails to said work table, said guide rails defining a feed path across the work table in an X-direction underneath said marking wheel, said tag feeder comprising a base support for said floor, said base support being supported on a work surface base independent of said marking machine and connecting means being provided for rigidly connecting said base support to said marking machine, said connecting means being provided with means for adjusting said base support to said marking machine in an adjustable X-Y relation, said last named means comprising a pair of slots at one side of said plate extending in an X-direction and a second pair of slots extending in a Y-direction at a second side of said plate and connecting screws fitting through said slots for connecting said plate to the marking machine and the base support, said rigid plate being comprised of a first horizontal marking machine connecting portion and a second horizontal feeder connecting portion vertically spaced therefrom and connected thereto by an intermediate bend portion to accommodate vertical adjustment while maintaining a rigid X-Y relation.

* * * * *